United States Patent [19]

Jauch

[11] 4,050,236

[45] Sept. 27, 1977

[54] CLOCK HAVING ORNAMENTAL PENDULUM WITH ADJUSTABLE PERIOD

[75] Inventor: Christian M. J. Jauch, Louisville, Miss.

[73] Assignee: Spartus Corporation, Chicago, Ill.

[21] Appl. No.: 674,954

[22] Filed: Apr. 8, 1976

[51] Int. Cl.[2] ..... G04B 17/12

[52] U.S. Cl. ..... 58/132

[58] Field of Search ..... 58/29-32, 58/129-135

[56] References Cited

U.S. PATENT DOCUMENTS

| | | | |
|---|---|---|---|
| 235,665 | 12/1880 | Barrett | 58/129 |
| 3,486,323 | 12/1969 | Franz | 58/130 A |

*Primary Examiner*—E. S. Jackmon

*Attorney, Agent, or Firm*—Merriam, Marshall, Shapiro & Klose

[57] ABSTRACT

A clock has an ornamental pendulum which serves an aesthetic function but does not control the clock mechanism. The pendulum is mounted for free swinging movement on an oscillating shaft in such a manner that, when the pendulum swings in synchronism with the oscillating shaft, the pendulum will be driven by the shaft, but, when the pendulum swings out of synchronism with the oscillating shaft, the pendulum will eventually stop swinging. Adjusting structure is provided to impart to the pendulum a natural period of swing which is in synchronism with the oscillating shaft.

2 Claims, 3 Drawing Figures

CLOCK HAVING ORNAMENTAL PENDULUM WITH ADJUSTABLE PERIOD

BACKGROUND OF THE INVENTION

The present invention relates generally to pendulum clocks and more particularly to clocks having a swinging pendulum which serves an aesthetic purpose but does not control the clock mechanism.

Some conventional weight driven or spring driven clocks utilize a pendulum to control the clock mechanism. Other clocks, such as electrically powered clocks, do not, and this is particularly true for mass produced, low cost clocks. However, many prospective clock purchasers consider clocks with pendulums to be desirable, from an aesthetic standpoint. To supply these tastes, clock manufacturers produce an electrically driven clock having an ornamental swinging pendulum, which simulates, in appearance, the pendulum in a pendulum-controlled mechanically driven clock, but performs no clock-controlling function.

One conventional manner of swinging or oscillating the ornamental pendulum in such a clock is to drive the pendulum directly with a cam mechanism driven by the same electric motor as drives the clock mechanism. Although this is satisfactory for short pendulums (e.g., up to about 6 inches in length), it is unsatisfactory for longer pendulums for the reasons explained below. For a given length and mass, a pendulum has a constant, unchanging period of oscillation (its "natural period"), which is the time it takes for the pendulum to move through one complete arc of its swing. The period is directly proportional to the pendulum length, i.e., the distance between the pivotal axis of the pendulum and its center of mass. A conventional pendulum consists of a very thin rod with a massive bob at the end of the rod so as to locate the center of mass at the bob.

When a pendulum is directly driven by a cam mechanism, or the like, there is imparted to the pendulum an oscillation period corresponding to the speed of operation of the cam. This oscillation period usually differs from the natural period of the pendulum, and the pendulum tends to resist the artificial oscillation period thereby resulting in jerky, uneven movements by the pendulum. Generally, for ornamental pendulums, the artificial oscillation period is longer than the natural period of the ornamental pendulum, per se.

A prior art solution to this problem involved two atlernatives. One alternative was to carefully control the length and other parameters of the pendulum to provide it with a natural period corresponding to the oscillation period imparted by the cam mechanism. The other prior art alternative, especially where the aesthetics or other considerations did not permit increasing the length of the ornamental pendulum, was to mount the ornamental pendulum in free swinging relation on a shaft oscillated by the cam mechanism and fix the ornamental pendulum to a heavy, non-decorative arm which extended above the pivotal axis of the pendulum and was hidden from view. The counterbalancing weight of the upwardly extending arm had the same effect as increasing the length of the pendulum.

However, in the case of the free swinging pendulum with the upwardly extending arm, unless the pendulum had a natural period identical to the oscillation period imparted by the cam mechanism, the pendulum would eventually stop swinging. To assure that the pendulum with the upwardly extending arm had a period identical to the oscillation period imparted by the cam mechanism, required precise dimensional tolerances and careful manufacturing practices with respect to both the cam mechanism and the pendulum; and these factors were inconsistent with mass producing low cost clocks.

SUMMARY OF THE INVENTION

The present invention provides a pendulum and associated structure which premit the pendulum to swing with a natural period identical to the oscillation period imparted by the cam mechanism but does not require close dimensional tolerances or careful manufacturing practices with respect to either the pendulum or the cam mechanism.

The cam mechanism (or other appropriate structure) oscillate a shaft defining the pivotal axis of the pendulum. Structure is provided which mounts the pendulum on the oscillating shaft to swing freely in relation to the shaft. In addition, the mounting structure imparts a driving force from the oscillating shaft to the pendulum to provide continuous, uninterrupted, swinging of the pendulum when the shaft and the pendulum oscillate in synchronism. Associated with the pendulum are adjusting means for adjusting the period of the free swinging pendulum to synchronize the period of the pendulum with the oscillation period of the shaft, without changing the length or other dimensions of the pendulum.

The pendulum and its associated adjusting structure, as well as the oscillating shaft and its driving mechanism, may be manufactured without the close tolerances or careful manufacturing practices necessary to assure identical oscillating periods, as was the case with the prior art structures.

Using this arrangement, one adjustable pendulum can accommodate a variety of different oscillating shafts each oscillating with a different oscillating period; and one pendulum of a given length can be made to swing through a relatively large number of differing periods.

Other features and advantages are inherent in the structure claimed and disclosed or will become apparent to those skilled in the art from the following detailed description in conjunction with the accompanying diagrammatic drawing.

DETAILED DESCRIPTION

Figure 1:
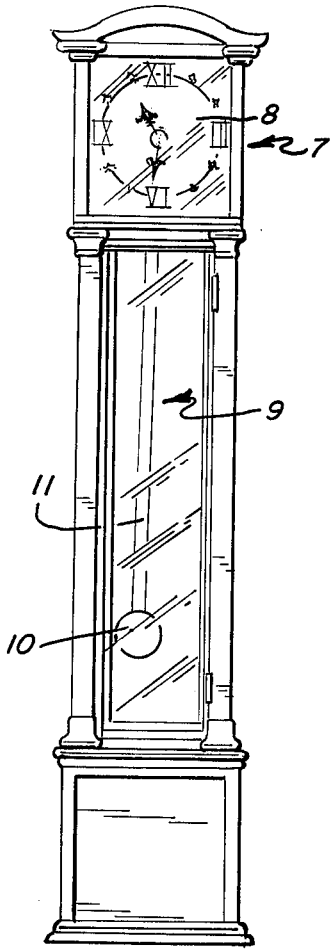
FIG. 1 is a front elevational view of a clock having an adjustable pendulum in accordance with an embodiment of the present invention.

Referring to FIG. 1, indicated generally at 7 is a clock having a face 8 and a pendulum 9 comprising a visible pendulum rod 11 and a bob 10 located at the lower end of rod 11. This pendulum is provided for aesthetic purposes and has no control over any part of the clock mechanism.

Figure 2:
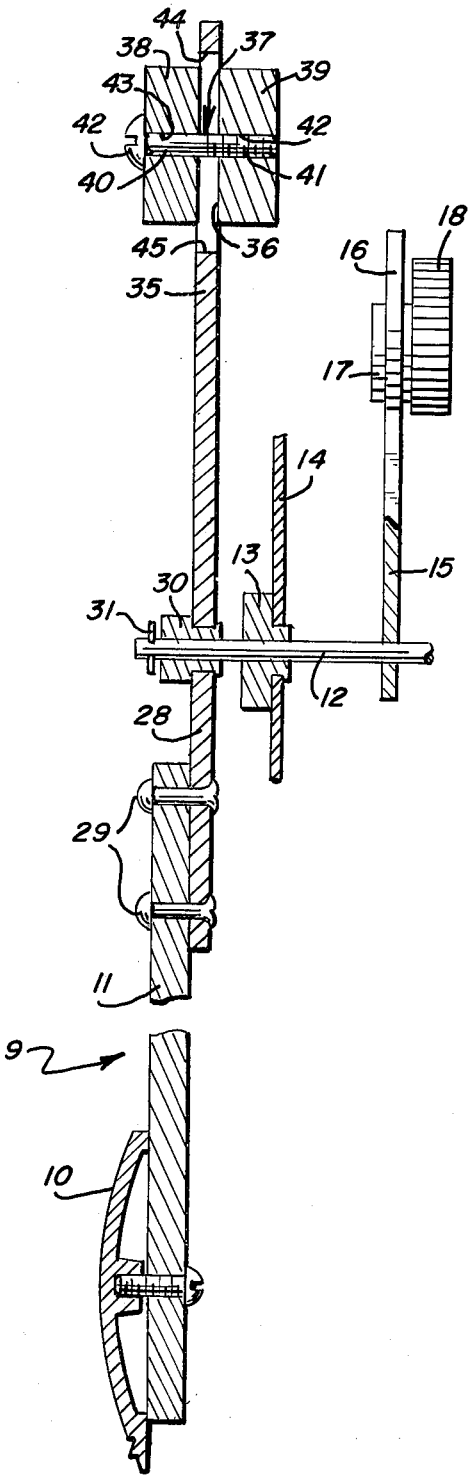
FIG. 2 is a side sectional view of a portion of the adjustable pendulum and associated structure.
Figure 3:
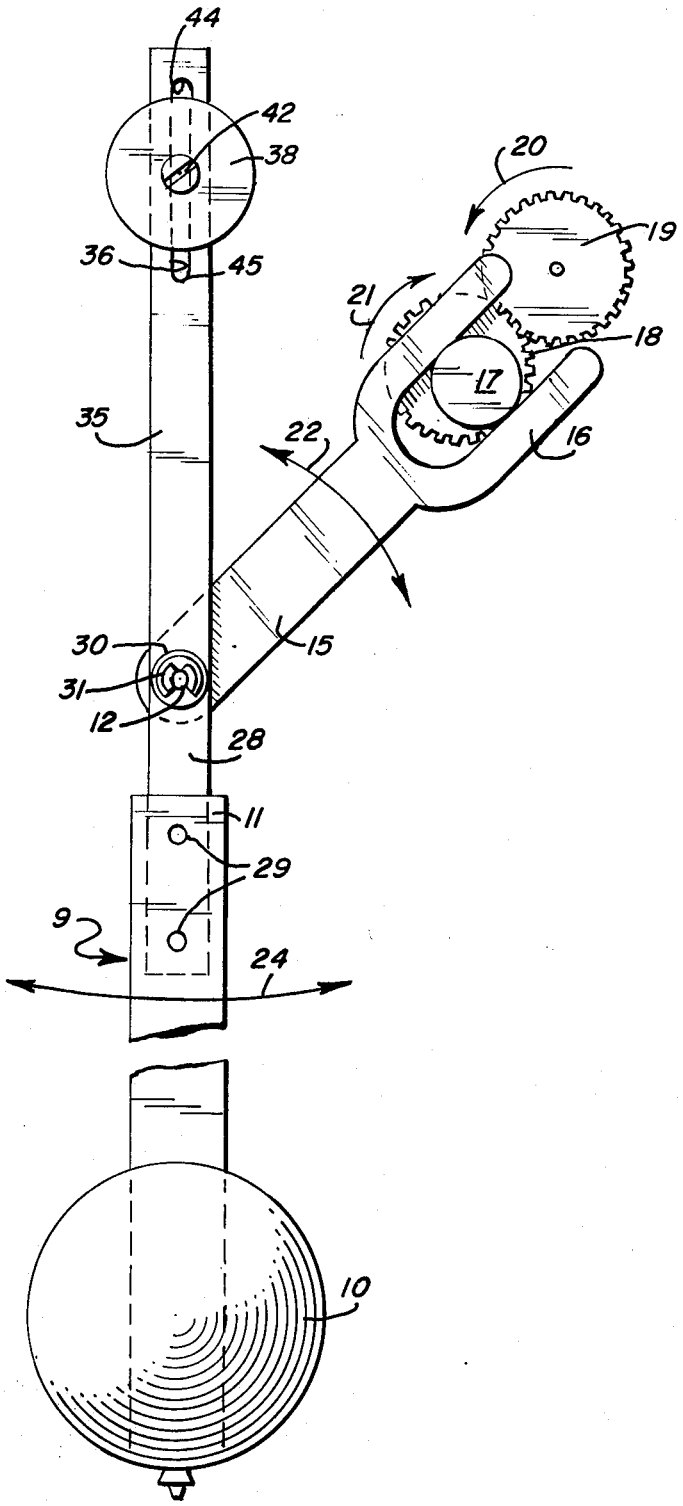
FIG. 3 is a front view of the structure shown in FIG. 2.

Referring now to FIGS. 2 and 3, the pendulum is mounted for free swinging movement about the axis of, and at one end of, a shaft 12 extending through a bearing 13 carried by a support plate 14 on the clock mechanism (not shown in FIGS. 2 and 3 but located behind clock face 8). The clock mechanism is of conventional construction and may be driven by an electric motor powered by a battery or by plugging a cord into a wall socket. Fixed to the other end of shaft 12 is one end of a lever 15 having a bifurcated portion 16 at its other end. Bifurcated portion 16 is engaged by the surface of a cam 17 on a first gear 18 driven by a second gear 19 in turn driven by a gear train (not shown) driven by the same motive means as drives the clock mechanism.

Gear 19 is driven in a counterclockwise sense as shown by the arrow 20 in FIG. 3 and in turn drives gear 18 and can 17 in a clockwise sense as shown by the arrow 21 in FIG. 3. Cam 17 engages the arms of bifurcated lever portion 16 and, as it rotates, cam 17 causes lever 15 to oscillate in the directions indicated at arrow 22 in FIG. 3. Lever 15, being fixed to shaft 12, in turn oscillates shaft 12 in clockwise and counterclockwise directions about its axis.

Pendulum 9 is mounted for free swinging movement in relation to oscillating shaft 12 by structure not to be described. Rod 11 connected to an arm 28 by rivets 29. Fixed on, and extending through, arm 28 is a bushing 30 rotatably mounted on shaft 12 and retained thereon by a conventional E-ring 31, for example.

Bushing 30 has a loose friction fit on shaft 12 which permits the pendulum to swing freely in relation to shaft 12. Preferably a thin film of conventional lubricant, such as oil or grease, is provided between shaft 12 and bushing 30. However, the pendulum would still swing freely even without a lubricant.

Although pendulum 9 is mounted for free swinging movement in relation to shaft 12, there is sufficient friction between shaft 12 and bushing 30 so that, when shaft 12 initially starts to oscillate, it imparts a driving force to the pendulum, through bushing 30, causing the pendulum to swing.

Once swinging movement of the pendulum has been initiated, there is an inherent tendency for the pendulum to swing in accordance with its natural period. On the other hand, oscillating shaft 12 is oscillating at a constant speed and through a constant arc, and, if the natural period of the swinging pendulum is not identical to the oscillating period of shaft 12, the pendulum will eventually swing to a stop.

However, if the pendulum has a natural period identical to the oscillating period of shaft 12, so that the two oscillate in synchronism, the pendulum will swing continuously without interruption because the movement of shaft 12 will continue to impart sufficient driving force to pendulum 9 through bushing 30 to continue the swinging of the pendulum.

The parameters of the ornamental pendulum rod 11 and bob 10 are normally less than that required to impart to the pendulum a natural period identical to the oscillating period of shaft 12. In accordance with the present invention, the pendulum is provided with a natural period identical to the oscillating period of shaft 12, using adjusting structure now to be described.

As previously noted arm 28 is fixed to and in line with pendulum rod 11. Arm 28 includes an upper portion 35 extending upwardly from oscillating shaft 12.

Located on upper arm portion 35 is an elongated slot 36 through which extends a threaded member indicated generally at 37 and having a grooved head 42, an unthreaded shank portion 40 and a threaded shank portion 41. Mounted on unthreaded shank portion 40 is a weight 38 having an opening 43 through which shank portion 40 extends, and mounted on threaded shank portion 41 is a weight 39 having a threaded opening 42 in which threaded shank portion 41 engages.

When threaded member 37 is tightened, e.g., by inserting a screw driver in the grooved head 42 of member 37, weights 38, 39 tightly engage opposite surfaces of upper arm portion 35 around slot 36 to hold the entire weight assembly, comprising threaded member 37 and weights 38, 39, in a fixed location relative to the axis of oscillating shaft 12. When threaded member 37 is loosened, the entire weight assembly 37, 38, 39 may be moved along the length of slot 36 to vary the distance of the weight assembly from the axis of shaft 12.

Increasing the distance between weight assembly 37–39 and shaft 12 has the same effect as increasing the length of the pendulum rod. This in turn increases the natrual period of the pendulum. Thus, if the pendulum is swinging through a natural period which is less than the oscillating period of shaft 12, the weight assembly 37–39 is loosened and moved upwardly along slot 36 until a location is determined which will provide the pendulum with a natural period identical to the oscillating period of shaft 12.

Decreasing the distance between weight assembly 37–39 and shaft 12 has the same effect as decreasing the length of the pendulum rod. This in turn decreases the natural period of the pendulum. Thus, if the pendulum is swinging through a natural period which is more than the oscillating period of shaft 12, the weight assembly 37–39 is loosened and moved downwardly along slot 36 until a location is determined which will provide the pendulum with a natural period identical to the oscillating period of shaft 12.

Thus, any difference between the period of osciallating shaft 12 and the natural period of adjustable pendulum 9 can be accommodated by changing the location of the weight assembly on upper arm portion 35. If, after an initial adjustment, the respective periods of the oscillating shaft and the adjustable pendulum are still not the same, a further adjustment of the location of the weight assembly can be made. One or two trial and error adjustments are usually all that is necessary to find the location for the weight assembly which will provide the adjustable pendulum with a period identical to the period of the oscillating shaft. Once this location has been determined the weight assembly is locked in place by tightening threaded member 37.

Slot 36 has upper and lower ends 44, 45, respectively, which are engageable with threaded member 37 to define upper and lower limits to the movement of weight assembly 37–39. More specifically, engagement of upper slot end 44 with threaded member 37 limits the adjustment of the weight assembly in an upward direction away from shaft 12, and engagement of lower slot end 45 with threaded member 37 defines the limit for adjustment of the weight assembly in a downward direction toward shaft 12. When threaded member 37 engages lower slot end 45, the weight assembly, at that location, imparts to the pendulum a period which is less than the period of the oscillating shaft; and when threaded member 37 engages upper slot end 44, the weight assembly, at that location, imparts to the pendulum a period which is greater than the oscillating period of shaft 12.

Arm 28 and its associated adjusting structure, comprising slot 36 and weight assembly 37–39, is quite versatile in that the same arm and adjusting structure, as well as the cam operated pendulum-oscillating mechanism therefor, can be used with a variety of different models of ornamental pendulums having a variety of weights and dimensions, and all of these elements may be mass produced without close tolerances and without careful manufacturing practices.

In a typical embodiment, cam 17 rotates at a speed of 26.78 RPM to impart to oscillating shaft 12 an oscillating period of 2.24 seconds. The ornamental pendulum comprises bob 7 and rod 11. A typical ornamental pendulum has a length, from the axis of shaft 12 to the center of bob 7 of 28.25 inches. The weight of rod 11 and bob 7 is 50.3 grams, and the ornamental pendulum per se has a natural period, before adjustment, of 1.7 seconds. To match the period of oscillating shaft 12 (2.24 seconds) would require a pendulum length of 49.11 inches.

The distance from the axis of shaft 12 to the upper end of arm 28 is 5.50 inches. The length of slot 36 is 1.75 inches, and the distance from the lower slot end 45 to the axis of shaft 12 is 3.375 inches. The weight of weight assembly 37–39 is 110.50 grams. This weight assembly can be adjusted to a location between the upper and lower ends of slot 36 to impart to the visible pendulum 9 a period of 2.24 seconds which is identical to the period of oscillating shaft 12. If the weight assembly is adjusted to a location at which threaded member 37 engages slot lower end 45, pendulum 9 has a period less than 2.24 seconds, and if the weight assembly is adjusted to a location at which threaded member 37 engages upper slot end 44, pendulum 9 has a period greater than 2.24 seconds.

If, for any reason, pendulum 9 is held or prevented from swinging, shaft 12 would simple oscillate within bushing 30 without strain or damage to the gears or other driving mechanism for cam 17. This would not be possible if the pendulum were fixed on shaft 12 rather than mounted thereon in free swinging relation in accordance with the present invention.

The foregoing detailed description has been given for clearness of understanding only, and no unnecessary limitations should be understood therefrom, as modifications will be obvious to those skilled in the art.

What is claimed is:

1. In a clock:

a shaft;

a pendulum having a bob;

means for oscillating said shaft to and fro about its axis and for controlling the speed of oscillation of said shaft, said controlling means being independent of said pendulum;

means, comprising bushing means fixed to said pendulum and having a loose friction fit on said shaft, mounting said pendulum on said shaft for free swinging movement of said pendulum in relation to said shaft;

said mounting means including means for imparting a driving force from said oscillating shaft to said pendulum, to provide continuous, uninterrupted swinging of the pendulum, when the shaft and pendulum oscillate in synchronism;

said loose friction fit between said bushing means and said shaft being the sole driving connection between said shaft and said bushing means and pendulum;

and adjusting means for adjusting the period of said free swinging pendulum, to synchronize said period with the oscillation of said shaft, without changing the distance between the axis of said shaft and the bob of said pendulum.

2. In a clock as recited in claim 1 wherein said pendulum comprises a rod extending downwardly in relation to said shaft and said adjusting means comprises;

an arm portion extending upwardly from said shaft in line with and connected to said pendulum rod to swing therewith;

weight means;

means for adjusting the location of said weight means along the length of said arm portion above said shaft to vary the distance of said weight means from the axis of said shaft and thereby vary the period of said pendulum;

first limit means for limiting the adjustment of said weight means in a first direction toward said shaft;

second limit means for limiting the adjustment of said weight means in a second direction away from said shaft;

said weight means, said limit means and said location adjusting means comprising means cooperating to impart to said pendulum a perid which is (a) less than the period of said oscillating shaft when the weight means is limited by said first limit means and (b) greater than the period of said oscillating shaft when the weight means is limited by said second limit means.

* * * * *

UNITED STATES PATENT AND TRADEMARK OFFICE

CERTIFICATE OF CORRECTION

PATENT NO. : 4,050,236

DATED : September 27, 1977

INVENTOR(S) : Christian M. J. Jauch

It is certified that error appears in the above-identified patent and that said Letters Patent are hereby corrected as shown below:

Col. 2, line 9, change "premit" to --permit--;
line 16, change "oscillate" to --oscillates--.
Col. 3, line 9, change "can" to --cam--.
Col. 4, line 14, change "natrual" to --natural--;
line 31, change "osciallating" to --oscillating--.
Col. 5, line 31, change "simple" to --simply--.
Col. 6, after Claim 2, add Claim 3 as follows:

--3. In a clock as recited in Claim 1 wherein:

said bob is fixed on the pendulum;

said pendulum has fixed dimensions which impart to the pendulum a natural period less than the oscillating period of said shaft; and said adjusting means comprises means for increasing the period of said pendulum without changing the pendulum's dimensions.--

UNITED STATES PATENT OFFICE

CERTIFICATE OF CORRECTION

Patent No. 4,050,236 Dated September 27, 1977

Inventor(s) Christian M. J. Jauch

It is certified that error appears in the above-identified patent and that said Letters Patent are hereby corrected as shown below:

On the cover sheet "2 Claims, 3 Drawing Figures" should read -- 3 Claims, 3 Drawing Figures --.

Signed and Sealed this

Seventh Day of March 1978

[SEAL]

Attest:

RUTH C. MASON
Attesting Officer

LUTRELLE F. PARKER
Acting Commissioner of Patents and Trademarks